US012123674B1

(12) United States Patent
Mantas

(10) Patent No.: US 12,123,674 B1
(45) Date of Patent: Oct. 22, 2024

(54) EXTERNAL ELASTIC SKIN-BASED RECOIL REDUCTION MECHANISM FOR A FIREARM

(71) Applicant: Dimitrios Mantas, Athens (GR)

(72) Inventor: Dimitrios Mantas, Athens (GR)

( * ) Notice: Subject to any disclaimer, the term of this patent is extended or adjusted under 35 U.S.C. 154(b) by 0 days.

(21) Appl. No.: 18/366,884

(22) Filed: Aug. 8, 2023

(51) Int. Cl.
*F41A 3/78* (2006.01)
*F41C 23/06* (2006.01)

(52) U.S. Cl.
CPC ..... *F41A 3/78* (2013.01); *F41C 23/06* (2013.01)

(58) Field of Classification Search
CPC .... F41A 3/78; F41A 35/00; F41A 3/89; F41C 23/06; F41C 27/00
See application file for complete search history.

(56) References Cited

U.S. PATENT DOCUMENTS 1,019,937 A 3/1912 Whittier
1,360,873 A 11/1920 Nils
1,367,354 A 2/1921 Craig
1,457,961 A 6/1923 Browning
1,563,675 A * 12/1925 Tansley ..... F41A 17/38 89/196
1,788,279 A 1/1931 Cutts
1,877,839 A 9/1932 Rudolf
2,286,133 A 6/1942 Williams
2,379,461 A 7/1945 Simpson
2,426,661 A 9/1947 Anderson
2,456,652 A 12/1948 Simpson
2,504,958 A 4/1950 Botts
2,779,249 A 1/1957 Saetter-Lassen
2,788,714 A 4/1957 Browning
2,791,945 A 5/1957 Maier
2,831,404 A 4/1958 Sampson
2,866,389 A 12/1958 Simpson
2,900,877 A 8/1959 Mcclenahan
2,973,694 A 3/1961 Herlach
3,082,667 A 3/1963 Ramseyer
3,251,270 A 5/1966 Paul
3,366,011 A 1/1968 Sturtevant
3,371,442 A 3/1968 Carlson
3,517,586 A 6/1970 Stoner
3,603,577 A 9/1971 Deraad
3,731,590 A 5/1973 Zimmerman
3,901,125 A * 8/1975 Raville ..... F41A 3/86 89/196
4,000,217 A 12/1976 Radici
4,028,993 A 6/1977 Reynolds
4,031,808 A 6/1977 Raville
4,057,003 A 11/1977 Atchisson
4,150,819 A 4/1979 Taylor
(Continued)

FOREIGN PATENT DOCUMENTS

FR 1088428 A 3/1955
FR 1151326 A 1/1958
WO 1996015416 A1 5/1996

*Primary Examiner* — Joshua E Freeman
(74) *Attorney, Agent, or Firm* — Notaro, Michalos & Zaccaria P.C.

(57) ABSTRACT

In some implementations, the device may include an elastic skin configured to be coupled over a front fixed portion of a frame of a firearm and a rear portion of a slide of a firearm. The elastic skin has a first low level of tension when the slide is in the first rest position and a second higher level of tension when the slide is in the second chamber position.

17 Claims, 4 Drawing Sheets

(56) References Cited

U.S. PATENT DOCUMENTS 4,201,113 A 5/1980 Seecamp
4,307,653 A 12/1981 Goes
4,439,943 A 4/1984 Brakhage
4,485,723 A 12/1984 Sarony
4,522,107 A * 6/1985 Woodcock ..... F41A 3/86 89/196
4,558,628 A 12/1985 Bosshard
4,569,144 A * 2/1986 Thurber ..... F41A 17/44 42/70.11
4,667,566 A 5/1987 Bosshard
4,677,897 A 7/1987 Barrett
4,754,689 A 7/1988 Grehl
4,961,277 A * 10/1990 Rosenbaum ..... F41A 17/44 42/70.11
4,972,760 A 11/1990 McDonnell
5,054,368 A 10/1991 Wentzel
5,060,555 A * 10/1991 Sater ..... F41A 3/78 89/196
5,069,110 A 12/1991 Menck
5,099,596 A * 3/1992 Butler, Jr. ..... F41A 17/44 42/70.11
5,279,202 A 1/1994 Bellardi
5,392,553 A 2/1995 Carey
5,513,730 A 5/1996 Petrovich
5,710,389 A 1/1998 Canaday
5,909,002 A 6/1999 Atchisson
6,758,126 B1 7/2004 Houtsma
6,829,974 B1 12/2004 Gwinn, Jr.
7,124,529 B1 10/2006 Havelka, Jr.
7,131,367 B1 11/2006 Boerschig
7,261,029 B1 8/2007 Davis
7,478,495 B1 1/2009 Alzamora
7,493,845 B2 2/2009 Mantas
7,793,453 B1 9/2010 Sewell, Jr.
7,971,381 B1 * 7/2011 Mikell ..... F41A 17/30 42/70.11
8,210,090 B2 7/2012 Brown
8,296,984 B2 10/2012 Kincel
8,297,176 B2 10/2012 Buschow
8,430,015 B2 4/2013 Faifer
8,555,540 B2 * 10/2013 Woodford ..... F41A 17/42 42/70.11
8,757,338 B2 6/2014 Miyasato
8,800,424 B2 8/2014 Gangl
8,939,059 B2 1/2015 Coffman, II
8,997,954 B2 4/2015 Rodenbeck
9,080,823 B1 7/2015 Mantas
9,267,747 B2 2/2016 Caudle
9,341,437 B1 5/2016 Huang
9,347,738 B1 5/2016 Schumacher
9,651,323 B1 5/2017 Mantas
9,739,566 B2 8/2017 Huang
9,915,492 B2 3/2018 Huang
9,921,013 B1 3/2018 Oglesby
9,970,722 B1 5/2018 Babb
10,006,739 B2 6/2018 Pollutro
10,054,378 B2 8/2018 Pawlowski
10,557,674 B1 2/2020 Mantas
2002/0053156 A1 5/2002 McCarthy
2003/0154640 A1 8/2003 Bragg
2004/0103777 A1 6/2004 Moore
2005/0246931 A1 11/2005 Poff
2006/0236853 A1 10/2006 Boersching
2008/0110074 A1 5/2008 Bucholtz
2008/0178508 A1 7/2008 Cinciu
2009/0001636 A1 1/2009 Miyasato
2009/0095584 A1 4/2009 Kondo
2010/0050492 A1 3/2010 Faifer
2010/0071246 A1 3/2010 Vesligai
2010/0122482 A1 5/2010 Simms
2010/0140031 A1 6/2010 Miyasato
2010/0281727 A1 11/2010 Quaedpeerds
2011/0101585 A1 5/2011 Kamae
2011/0138668 A1 6/2011 Thomas
2011/0179687 A1 7/2011 Caravaggi
2012/0285063 A1 * 11/2012 Woodford ..... F41A 17/44 42/70.11
2012/0297656 A1 11/2012 Langevin
2013/0319217 A1 12/2013 Gangl
2014/0059909 A1 3/2014 Caudle
2014/0075798 A1 3/2014 Kincel
2016/0010944 A1 1/2016 Downey
2017/0067716 A1 3/2017 Huang
2017/0130799 A1 5/2017 Spyche, Jr.
2017/0205164 A1 7/2017 Cassels
2017/0299295 A1 10/2017 Pawlowski
2017/0314886 A1 11/2017 Huang
2018/0010870 A1 1/2018 Mantas
2018/0224227 A1 8/2018 Durham, III
2024/0240906 A1 * 7/2024 Palanques-Fleck ..... F41A 3/78

* cited by examiner

EXTERNAL ELASTIC SKIN-BASED RECOIL REDUCTION MECHANISM FOR A FIREARM

FIELD

The present disclosure relates generally to the field of firearms and in particular to an external elastic skin-based recoil reduction mechanism for short action firearms that manages the recoil forces generated upon discharged of the firearm.

BACKGROUND OF THE INVENTION

A recoil reduction mechanism provides a way to reduce the recoil of a firearm caused as a reaction to being fired (discharged). The firearm is a mechanical system that, when discharged, causes a bullet to travel along the barrel and exit via the muzzle. The discharge of the firearm causes a resulting reactive force that is imparted to the firearm in the form of recoil. In addition, the explosion produced to propel the bullet causes an instantaneous kinetic energy applied to the frame of the firearm. Recoil springs are commonly used as a mechanism to dampen the recoil effect. Conventional recoil reduction mechanisms can be complex, bulky, heavy, difficult to maintain, and have limited ability for customization. Recoil springs are typically quite stiff and, as a result, can make it difficult for some users to properly chamber a load using the slide mechanism because of the stiffness of the recoil springs. In addition, recoil springs can suffer from aging effects, including loss of elasticity, fatigue, corrosion, creep, stress relaxation, etc.

There is a need for further improvements in recoil reduction mechanisms in terms of more optimal operation or modification thereof.

BRIEF DESCRIPTION OF THE DRAWINGS

The following detailed description, given by way of example and not intended to limit the present disclosure solely thereto, will best be understood in conjunction with the accompanying drawings in which.

DESCRIPTION OF THE PREFERRED EMBODIMENTS

In the present disclosure, like reference numbers refer to like elements throughout the drawings, which illustrate various exemplary embodiments of the present disclosure.

Figure 1A:
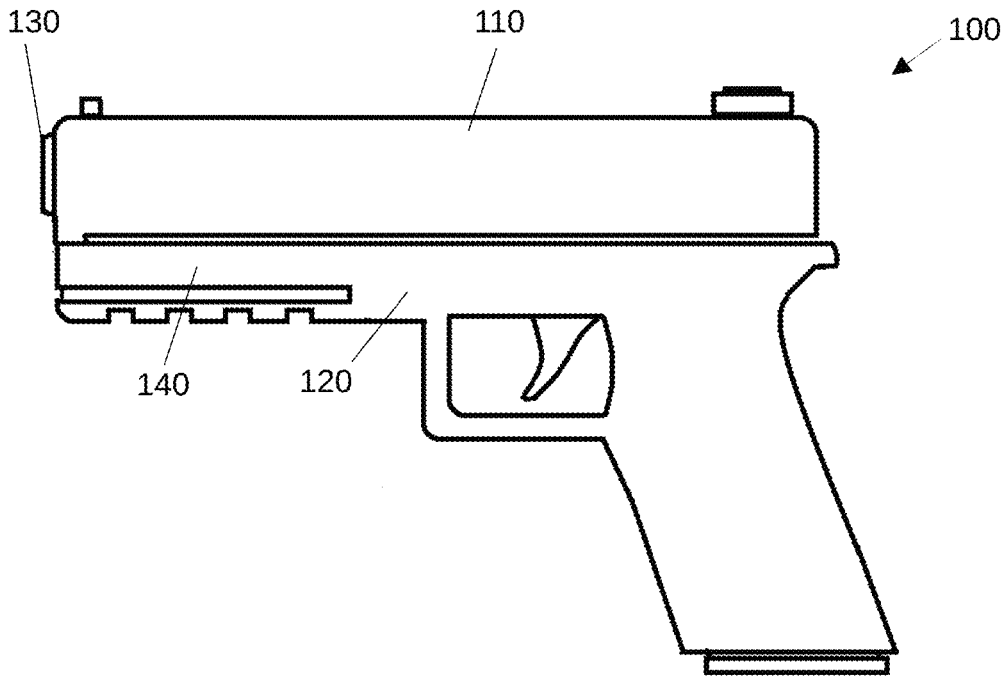
FIG. 1A is a side view of a firearm (pistol) with a conventional recoil reduction mechanism at rest and FIG. 1B is a side view of the conventional firearm (pistol) with the slide pulled back.
Figure 1B:
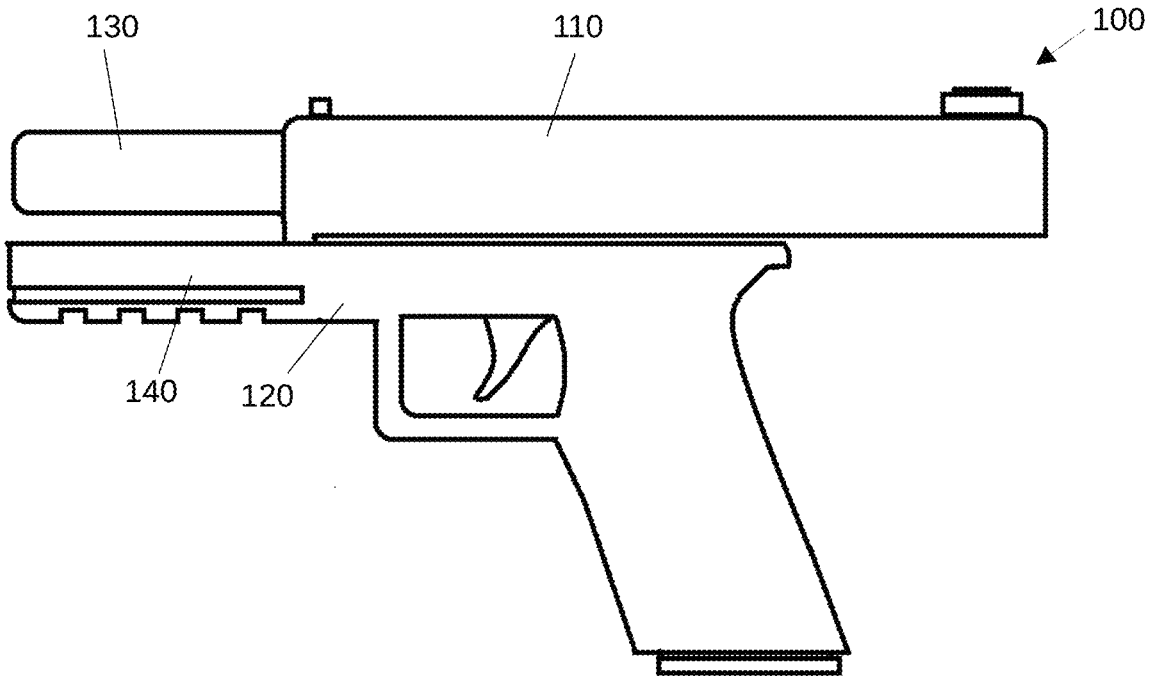

Referring now to FIG. 1A, a firearm 100 includes a slide 110 mounted over a barrel 130 mounted to a frame 120 with a spring-based recoil reduction mechanism 140 that is inside of frame 120 as known in the art. FIG. 1B shows the firearm 100 with the slide 110 pulled back to chamber a round, for example. When the slide 110 is pulled back to the position shown in FIG. 1B, a significant amount of force is required to compress the spring-based recoil reduction mechanism 140. As known in the art, the slide 110 will not remain in the position shown in FIG. 1B unless held there by a user because of the force exerted on the slide 110 by the spring(s) in the spring-based recoil reduction mechanism 140. Although such recoil reduction mechanisms provide adequate operation, replacement of the springs therein requires disassembly of the slide 110 from the frame 120.

Figure 2A:
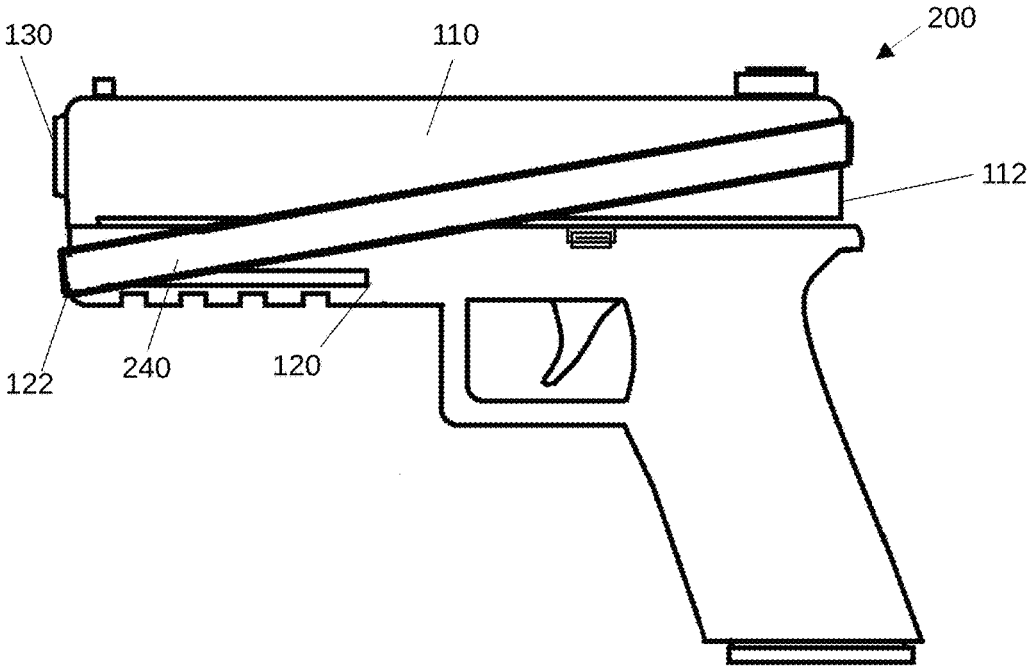
FIG. 2A is a side view of a firearm (pistol) with an external elastic skin-based recoil reduction mechanism of the present disclosure at rest and FIG. 2B is a side view of the firearm (pistol) of FIG. 2A with the slide pulled back.
Figure 2B:
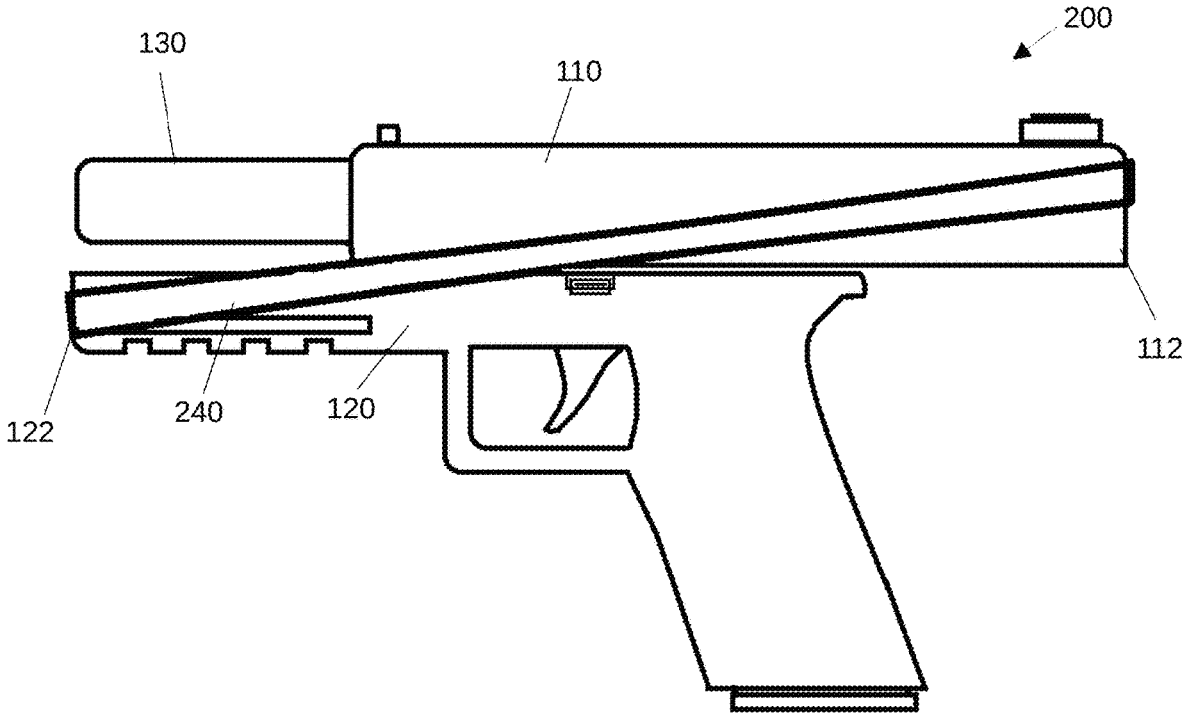

Referring now to FIG. 2A, a firearm 200 includes a slide 110 mounted over a barrel 130 mounted to a frame 120. In addition, instead of the spring-based recoil reduction mechanism 140, the firearm 200 has an external external elastic skin-based recoil reduction mechanism employing an outer elastic skin 240 that is looped around a front edge 122 of the frame 120 and a rear edge 112 of the slide 110. A small amount of tension exists on the outer elastic skin 240 when the slide 110 is in the position shown in FIG. 2A. FIG. 2B shows the firearm 100 with the slide 110 pulled back to chamber a round, for example. When the slide 110 is pulled back to the position shown in FIG. 2B, much more tension is placed on the outer elastic skin 240 so that when released by a user, the slide 110 will move back to the position shown in FIG. 2A based on the tension of the outer elastic skin 240. The outer elastic skin 240 may simply be an elastic band formed from an elastic material such as a natural rubber, a synthetic rubber compound, or the like, or may have a specially formed shape as discussed with respect to FIG. 4 below that is also formed from a natural rubber, a synthetic rubber compound, or the like. The outer elastic skin 240 may be provided with different tensions (or elasticity-set the by thickness thereof for example) in order to comply with the needs of various different users. For example, a user with arthritis or muscle weakness might want an outer elastic skin 240 with a low amount of tension.

In one alternative, the outer elastic skin 240 may be provided with a set amount of tension and a user desiring more tension than provided by a single outer elastic skin 240 may employ more than one outer elastic skin 240 at a time, effectively doubling the tension when a second outer elastic skin 240 is added and tripling the tension when a third outer elastic skin 240 is added. In another alternative, the outer elastic skin 240 may be provided with different set amounts of tension and a user desiring more tension than provided by a single outer elastic skin 240 may mix or match outer elastic skins 240 having different levels of tension in order to meet a desired tension level. In some embodiments, the width of the outer elastic skin 240 may be set wide enough to also function as an anti-slip surface for the firearm 200.

Figure 3A:
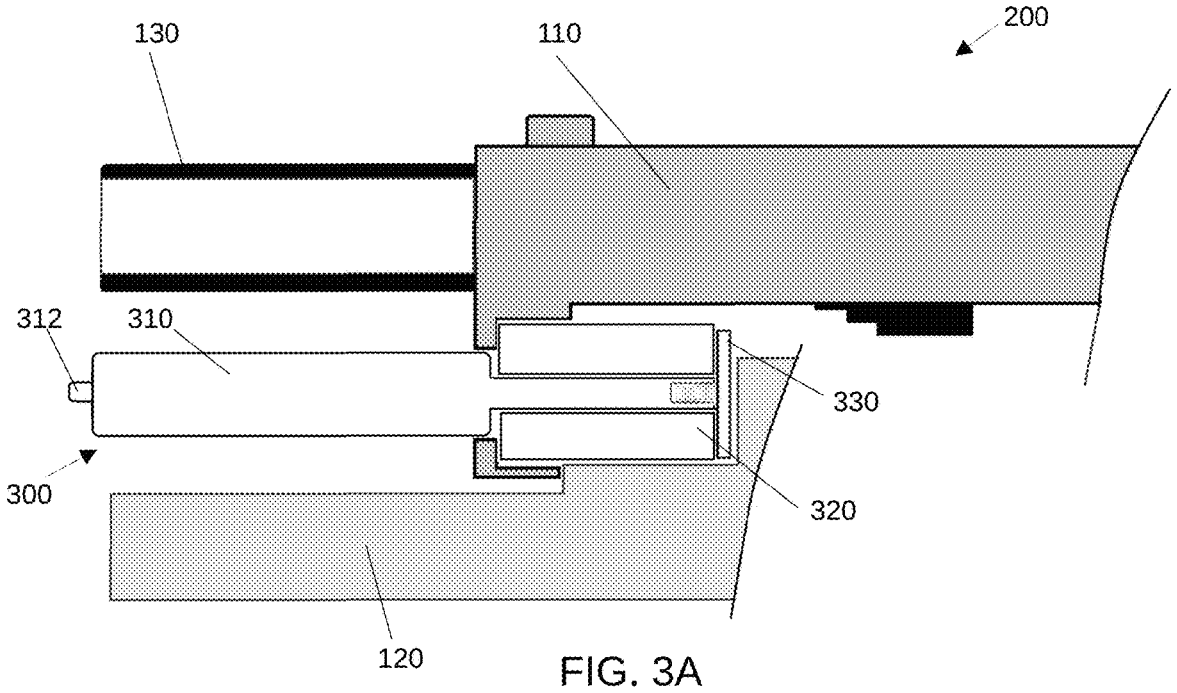
FIG. 3A is a side partial cut-away view of the firearm (pistol) of FIG. 2B showing the optional internal elastic buffer assembly of the external elastic skin-based recoil reduction mechanism of the present disclosure shown without the outer elastic skin.
Figure 3B:
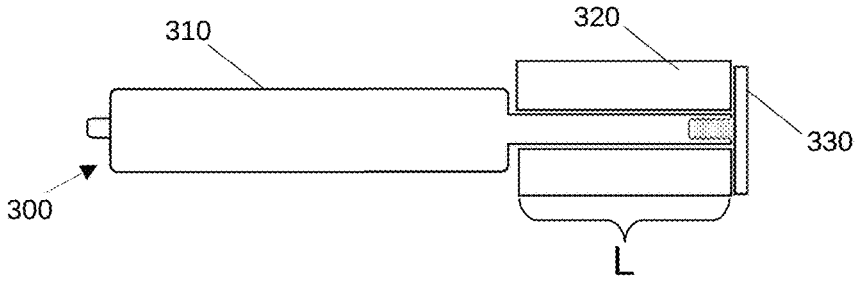
FIG. 3B is a side cut-away view of the assembled internal elastic buffer assembly.
Figure 3C:
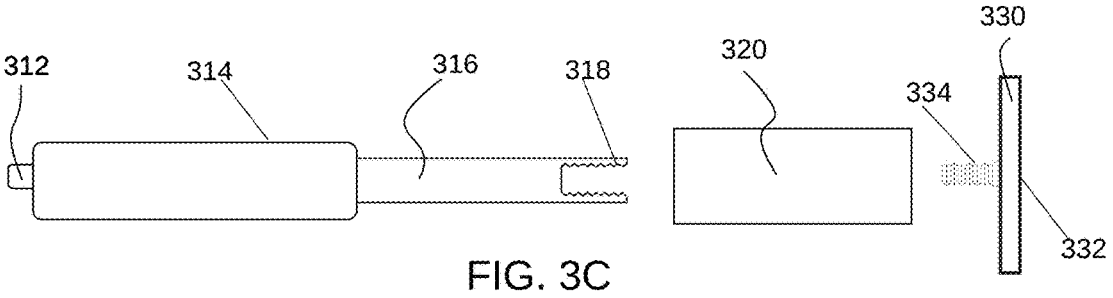
FIG. 3C is a side view of the assembled internal elastic buffer assembly, and FIG. 3D includes front and partial side views of a firearm including the view of the assembled internal elastic buffer assembly.

The external elastic skin-based recoil reduction mechanism of the present disclosure may include only the outer elastic skin 240 as shown in FIGS. 2A and 2B, with the space previously occupied by the spring-based recoil reduction mechanism empty. Because the empty space may result in metal-to-metal contact when the slide moves back (either for chambering or upon discharge), the external elastic skin-based recoil reduction mechanism of the present disclosure may further include an internal elastic buffer assembly 300 as shown in FIGS. 3A to 3D. FIG. 3A shows the internal elastic buffer assembly 300 mounted in the firearm adjacent to the slide 110 and frame 120 and in the space conventionally occupied by a spring-based recoil reduction mechanism. FIG. 3B shows the assembled internal elastic buffer assembly 300 alone, while FIG. 3C shows the disassembled internal elastic buffer assembly 300 alone.

The elastic buffer assembly 300 includes a rod 310 coupled to an endplate 330, with a cylindrical elastic bumper 320 having a cylindrical aperture (see FIG. 3B) placed over a first end of the rod 310 proximal to the endplate 330. The rod 310 may be coupled to the endplate 330 via an internally threaded aperture 318 at the first end of rod 310 and a threaded rod 334 extending from the plate portion 332 of the endplate 330. The rod 310 may include a tip portion 312 at a second end, opposite the first end, which extends out beyond an aperture 114 in the slide 110 and may mate with an aperture provided in the outer elastic skin 240 (shown in the FIG. 4 embodiment) in order to provide further assurance that the outer elastic skin 240 will stay in place. The rod 310 also includes a wider portion 314, sized slightly narrower than the aperture 114 in the slide 110, that extends from a position close to the second end of the rod 310 to a point just beyond the midpoint of the rod 310 and a narrower portion 316. The length of the narrower portion is equal to or just larger than the length L of the cylindrical elastic bumper 320 (here the length L represents the height of the cylinder part of the cylindrical elastic bumper 320). The length L chosen to ensure that the cylindrical elastic bumper 320 is long enough provide cushioning action that either prevents the slide 110 from contacting the frame 120 after discharge of the firearm 200 or minimizes (absorbs) the force of any such contact. The cylindrical elastic bumper 320 may be formed from an elastic material such as a natural rubber, a synthetic rubber compound, or the like.

Figure 3D:
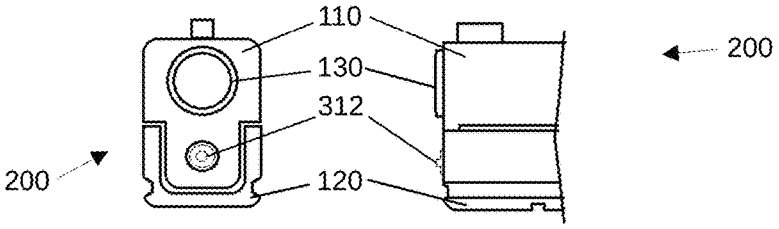
Figure 4:
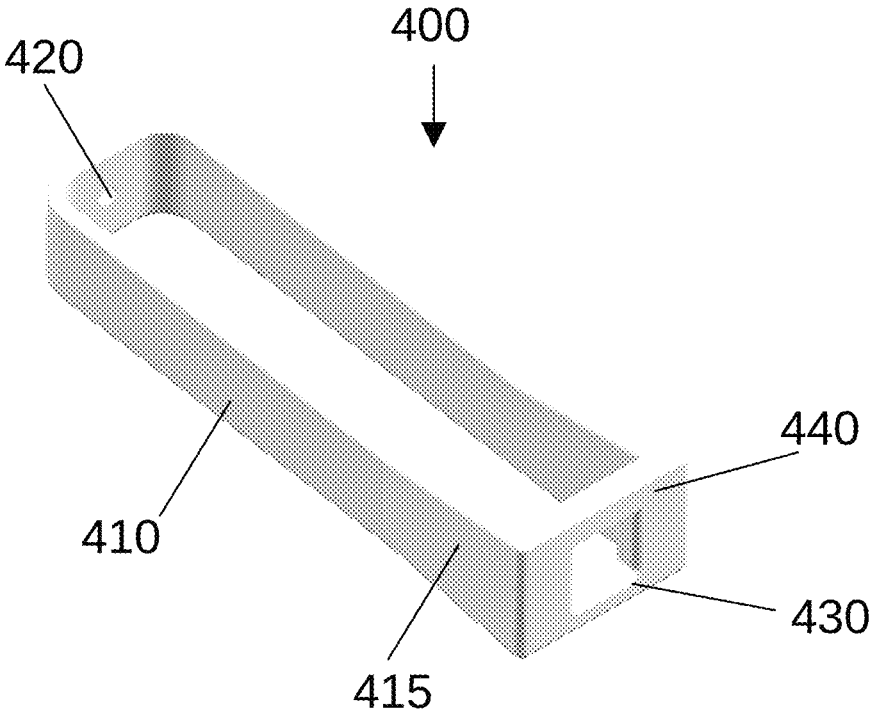
FIG. 4 is a perspective view of an elastic skin for use in the recoil reduction mechanism of the present disclosure.

FIG. 3D includes front and partial side views of the firearm 200 which show how the tip 312 is sized to extend out from the front portion of slide 110 so that it can mate with an aperture in the outer elastic skin (such as the aperture 420 in outer elastic skin 400 shown in FIG. 4).

Referring now to FIG. 4, in a further embodiment, an outer elastic skin 400 may include an aperture 420 at a first end for mating with the tip portion 312 of the rod 310. This can help the outer elastic skin 400 maintain position and keep from slipping off of the frame 120 of the firearm 200. The outer elastic skin 400 has a first width at and proximal to the first end and may also include a portion 415 which progressively widens from the first width at an area which is proximal to a second end thereof. Portion 415 can aid in gripping the slide 110 when chambering a round. The outer elastic skin 400 may also include a rear rectangular portion 440 sized to fit over the rear edge 112 of the slide 110 (see FIG. 2B). The outer elastic skin 400 may also include an aperture 430 in the rear rectangular portion 440. The aperture 430 may be square when the outer elastic skin 400 is used with a striker fired firearm to allow access (visual or manual) to the striker. The aperture 430 may be rectangular (or other shapes as necessary) when the outer elastic skin 400 is used with a hammer fired firearm for similar purposes.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A recoil reduction mechanism for a firearm having a frame and a slide, the slide movable between a first rest position and a second chamber position, the recoil reduction mechanism comprising:

an elastic skin configured to be coupled over a front fixed portion of the frame and a rear portion of the slide, the elastic skin having a first low level of tension when the slide is in the first rest position and a second higher level of tension when the slide is in the second chamber position.

2. The recoil reduction mechanism of claim 1, comprising an elastic buffer assembly mounted adjacent to the frame and the slide to reduce the force of contact between the slide and the frame after discharge.

3. The recoil reduction mechanism of claim 2, wherein the elastic buffer assembly comprises a rod coupled to an endplate at a first end and having an enlarged cylindrical portion adjacent to a second end thereof.

4. The recoil reduction mechanism of claim 3, comprising a cylindrical elastic buffer having an internal cylindrical aperture, the cylindrical elastic buffer mounted over the rod and position between the endplate and the enlarged cylindrical portion.

5. The recoil reduction mechanism of claim 4, wherein the cylindrical elastic buffer is formed from a natural rubber or a synthetic rubber compound.

6. The recoil reduction mechanism of claim 1, wherein the elastic skin is formed from a natural rubber or a synthetic rubber compound.

7. The recoil reduction mechanism of claim 1, wherein the elastic skin has a predetermined tension.

8. The recoil reduction mechanism of claim 1, wherein the elastic skin has an aperture at a first end thereof.

9. The recoil reduction mechanism of claim 3, wherein the rod has a tip extending from the second end thereof, and wherein the elastic skin has an aperture at a first end thereof that is adapted to fit over the tip of the rod.

10. The recoil reduction mechanism of claim 1, wherein the elastic skin has a rectangular portion at a second end thereof that is adapted to fit over the rear portion of the slide.

11. The recoil reduction mechanism of claim 10, wherein the elastic skin has an aperture in the rectangular portion at the second end thereof.

12. The recoil reduction mechanism of claim 1, wherein the elastic skin has a first width at and proximal to a first end thereof and a portion which progressively widens from the first width at an area proximal to the second end thereof.

13. A recoil reduction mechanism for a firearm having a frame and a slide, the slide movable between a first rest position and a second chamber position, the recoil reduction mechanism comprising:

a plurality of elastic skins configured to be coupled over a front fixed portion of the frame and a rear portion of the slide, each of the plurality of elastic skins having a first low level of tension when the slide is in the first rest position and a second higher level of tension when the slide is in the second chamber position.

14. The recoil reduction mechanism of claim 13, wherein each of the plurality of elastic skins has a same first low level of tension when the slide is in the first rest position.

15. The recoil reduction mechanism of claim 13, wherein each of the plurality of elastic skins has a same second higher level of tension when the slide is in the second chamber position.

16. The recoil reduction mechanism of claim 13, wherein one of the plurality of elastic skins has a different first low level of tension when the slide is in the first rest position than another of the plurality of elastic skins.

17. The recoil reduction mechanism of claim 13, wherein one of the plurality of elastic skins has a different second higher level of tension when the slide is in the second chamber position than another of the plurality of elastic skins.

* * * * *